US008366486B1

(12) United States Patent
Lan et al.

(10) Patent No.: US 8,366,486 B1
(45) Date of Patent: Feb. 5, 2013

(54) ELECTRICAL CONNECTOR

(75) Inventors: Rong-Qin Lan, New Taipei (TW); Li-Jun Xu, New Taipei (TW); Ming-Han Lin, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/293,554

(22) Filed: Nov. 10, 2011

(51) Int. Cl.
*H01R 9/03* (2006.01)

(52) U.S. Cl. ..... 439/607.54; 439/607.35

(58) Field of Classification Search ..... 439/607.01, 439/607.54, 607.55, 607.56, 607.35
See application file for complete search history.

(56) References Cited

U.S. PATENT DOCUMENTS 7,766,677 B2 * 8/2010 Chiang ..... 439/140
7,771,237 B2 * 8/2010 Lei et al. ..... 439/607.54
8,197,281 B2 * 6/2012 Yang ..... 439/499
8,202,123 B1 * 6/2012 Lin et al. ..... 439/607.54
8,303,343 B2 * 11/2012 Nagata ..... 439/607.54

* cited by examiner

*Primary Examiner* — Khiem Nguyen
(74) *Attorney, Agent, or Firm* — WPAT, P.C.; Anthony King

(57) ABSTRACT

An electrical connector includes an insulating housing, a plurality of terminals, a main shielding shell and an auxiliary shielding shell. The insulating housing includes a base body and a tongue portion. The insulating housing defines a plurality of terminal grooves of which each includes a receiving slot passing through a rear surface and a bottom surface of the base body. The terminals are received in the terminal grooves with soldering portions disposed in the receiving slots. A bottom face of the soldering portion is in alignment with the bottom surface of the base body to be soldered on a circuit board. The main shielding shell surrounds the tongue portion with the terminals. The auxiliary shielding shell has a base plate positioned to the rear surface of the base body to cover up top portions of the soldering portions, and two bending plates attached to the main shielding shell.

5 Claims, 4 Drawing Sheets

ELECTRICAL CONNECTOR

BACKGROUND OF THE INVENTION

1. Field of the Invention

The present invention generally relates to an electrical connector, and more particularly to an electrical connector with electromagnetic shielding function.

2. The Related Art

Referring to FIG. 1, a conventional electrical connector 200 includes an insulating housing 50, a plurality of terminals 60 and a shielding shell 70. The insulating housing 50 defines a plurality of terminal grooves 51 extending longitudinally to pass through a top of the insulating housing 50 and a rear of the insulating housing 50. Each of the terminals 60 has a fastening portion (not shown) disposed levelly. A rear end of the fastening portion extends upward and then is bent rearward to form a soldering portion 61. The terminals 60 are assembled in the insulating housing 50 with the fastening portions being fastened in the terminal grooves 51, and the soldering portions 61 projecting beyond the rear of the insulating housing 50 from the terminal grooves 51. The shielding shell 70 surrounds the insulating housing 50 together with the terminals 60. However, the soldering portions 61 of the terminals 60 are exposed outside the insulating housing 50 and the shielding shell 70 after the soldering portions 61 of the terminals 60 are soldered on a circuit board (not shown) that causes an electromagnetic interference when the conventional electrical connector 200 is in use.

SUMMARY OF THE INVENTION

An object of the present invention is to provide an electrical connector adapted for being soldered on a circuit board includes an insulating housing, a plurality of terminals, a main shielding shell and an auxiliary shielding shell. The insulating housing has a base body and a tongue portion protruding forward from a front of the base body. The insulating housing defines a plurality of terminal grooves of which each includes a passage extending longitudinally to pass through a top of the tongue portion and the base body, and a receiving slot passing through a rear surface and a bottom surface of the base body, and communicating with the passage. The terminals are received in the terminal grooves of the insulating housing. Each terminal has a fastening portion fastened in a rear of the passage, a contact portion connecting with a front of the fastening portion to be located in the passage and elastically project beyond the top of the tongue portion, and a soldering portion bent downward, and then extending forward from a rear of the fastening portion to be disposed in the receiving slot. A bottom face of the soldering portion is in alignment with the bottom surface of the base body to be soldered on the circuit board. The main shielding shell surrounds the tongue portion together with the terminals with the tongue portion being apart from periphery inner sides of the main shielding shell to define an insertion space between the periphery inner sides of the main shielding shell and periphery out sides of the tongue portion. The auxiliary shielding shell has a base plate positioned to the rear surface of the base body to cover up top portions of the soldering portions of the terminals which are exposed to the rear surface of the base body through the receiving slots, and two bending plates bent forward from two opposite sides of the base plate to be electrically attached to the main shielding shell.

As described above, the base plate of the auxiliary shielding shell is positioned to the rear surface of the base body with the bending plates attached to the main shielding shell to cover up the top portions the soldering portions. The bottom faces of the soldering portions are in alignment with the bottom surface of the base body to be soldered on the circuit board. As a result, the soldering portion of the terminal has no exposure area after being soldered on the circuit board so as to ensure a better electromagnetic shielding function.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
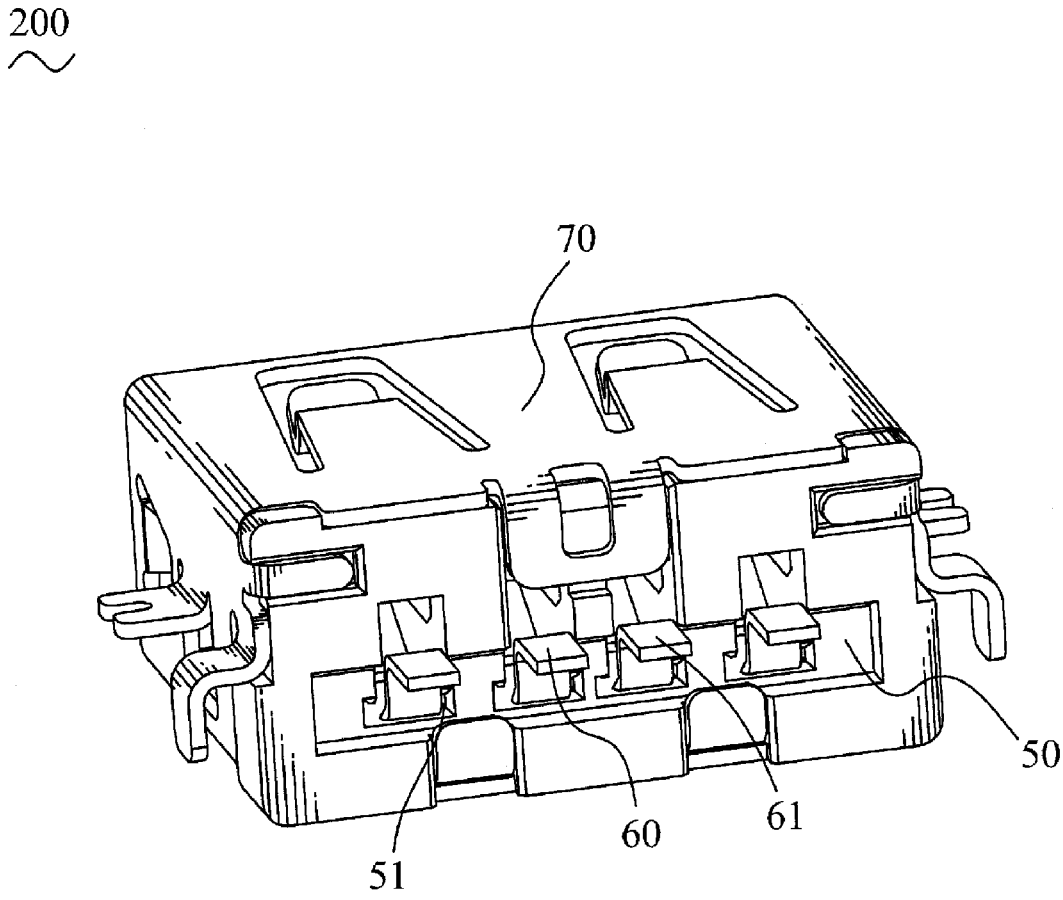
FIG. 1 is a perspective view of a conventional electrical connector.
Figure 2:
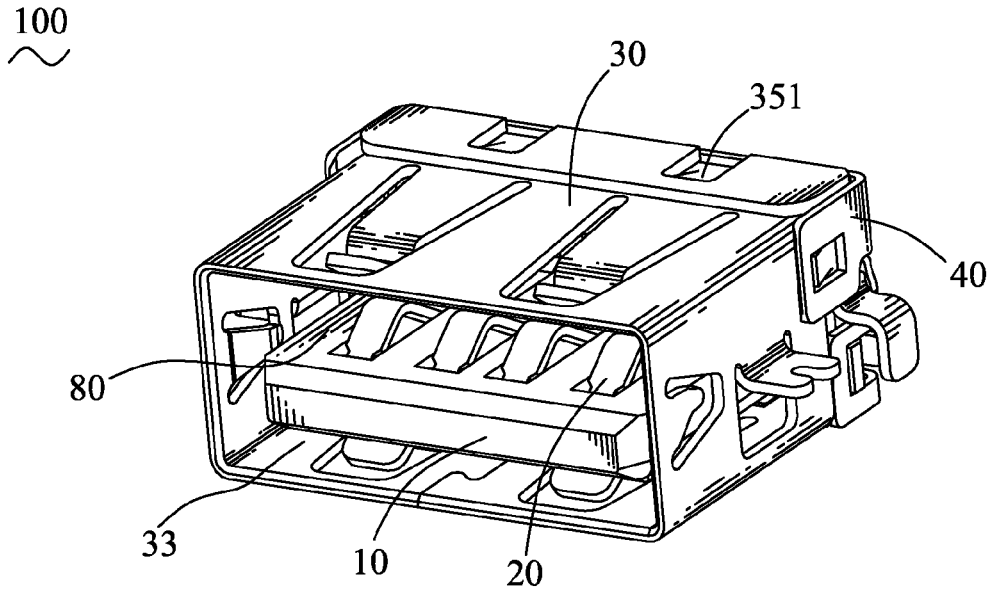
FIG. 2 is a perspective view of an electrical connector in accordance to the present invention.
Figure 3:
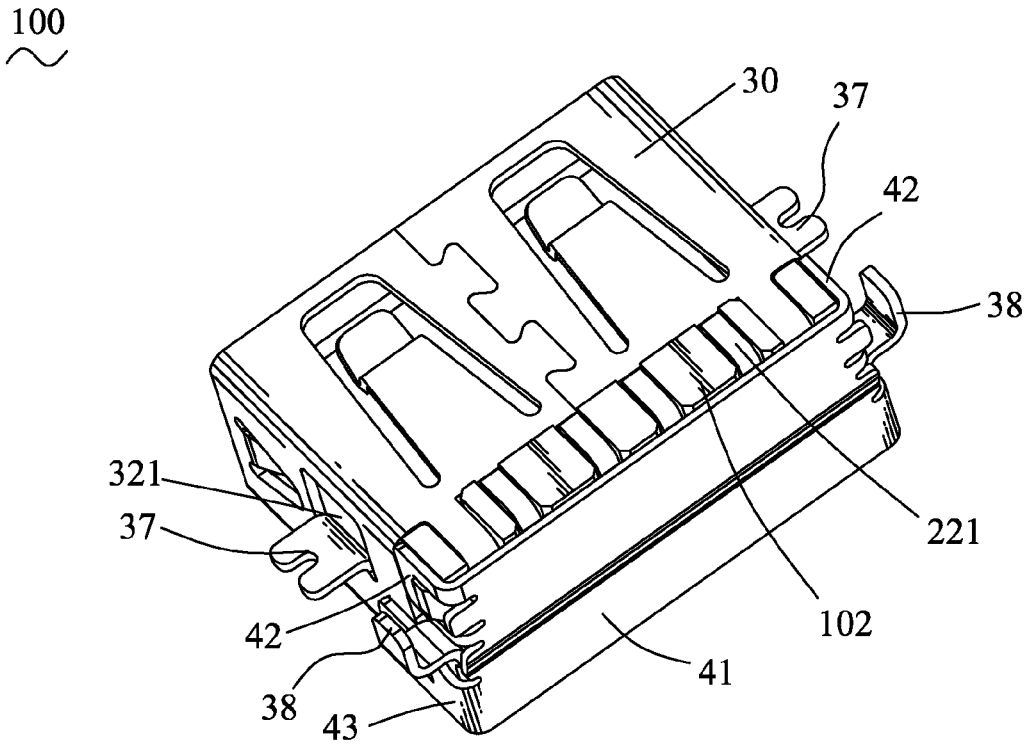
FIG. 3 is another angle of perspective view of the electrical connector of FIG. 1.

With reference to FIG. 2, FIG. 3, FIG. 4 and FIG. 5, an electrical connector 100 in accordance with the present invention is shown. The electrical connector 100 adapted for being soldered on a circuit board (not shown) includes an insulating housing 10, a plurality of terminals 20, a main shielding shell 30 and an auxiliary shielding shell 40.

Figure 4:
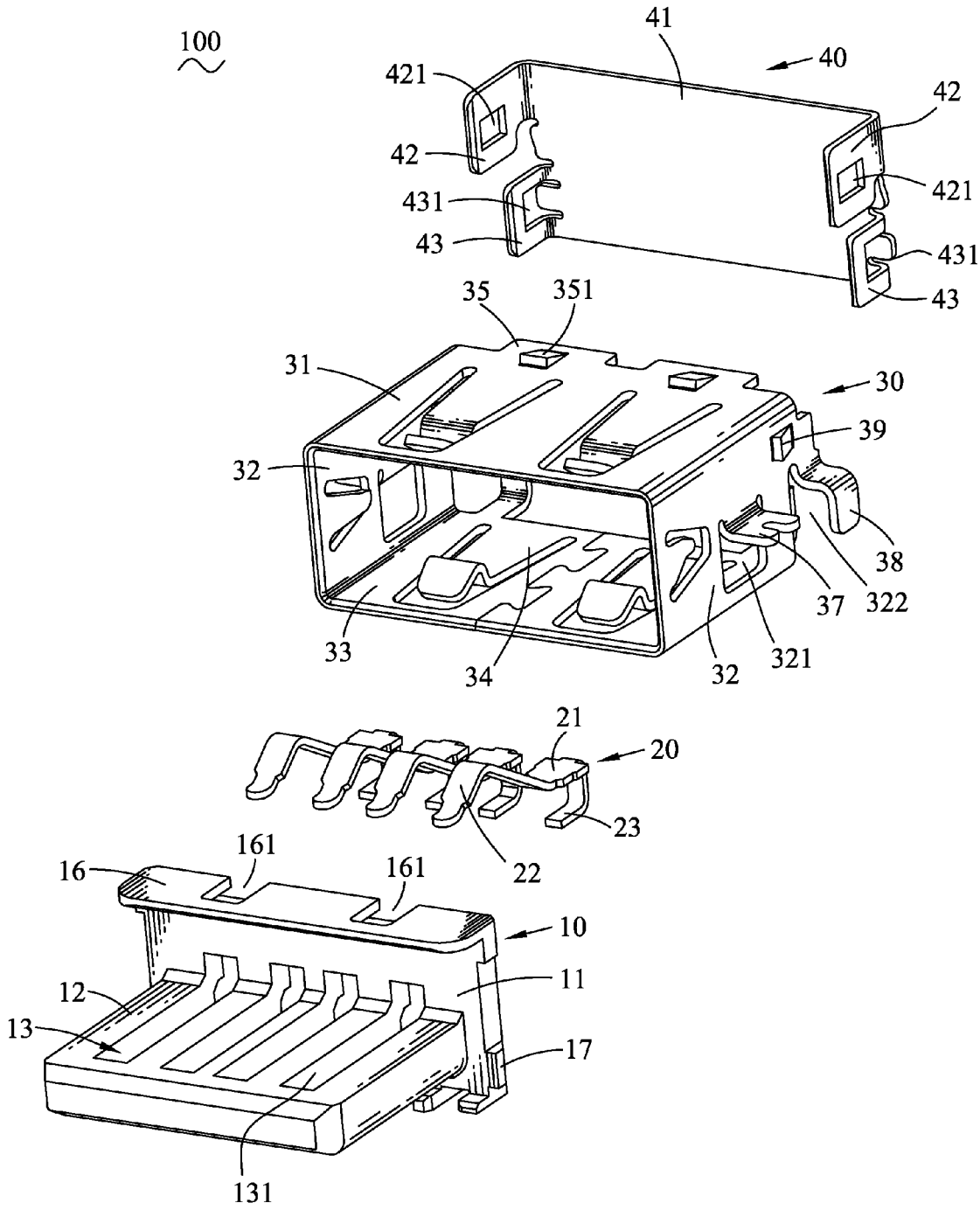
FIG. 4 is an exploded view of the electrical connector of FIG. 1.
Figure 5:
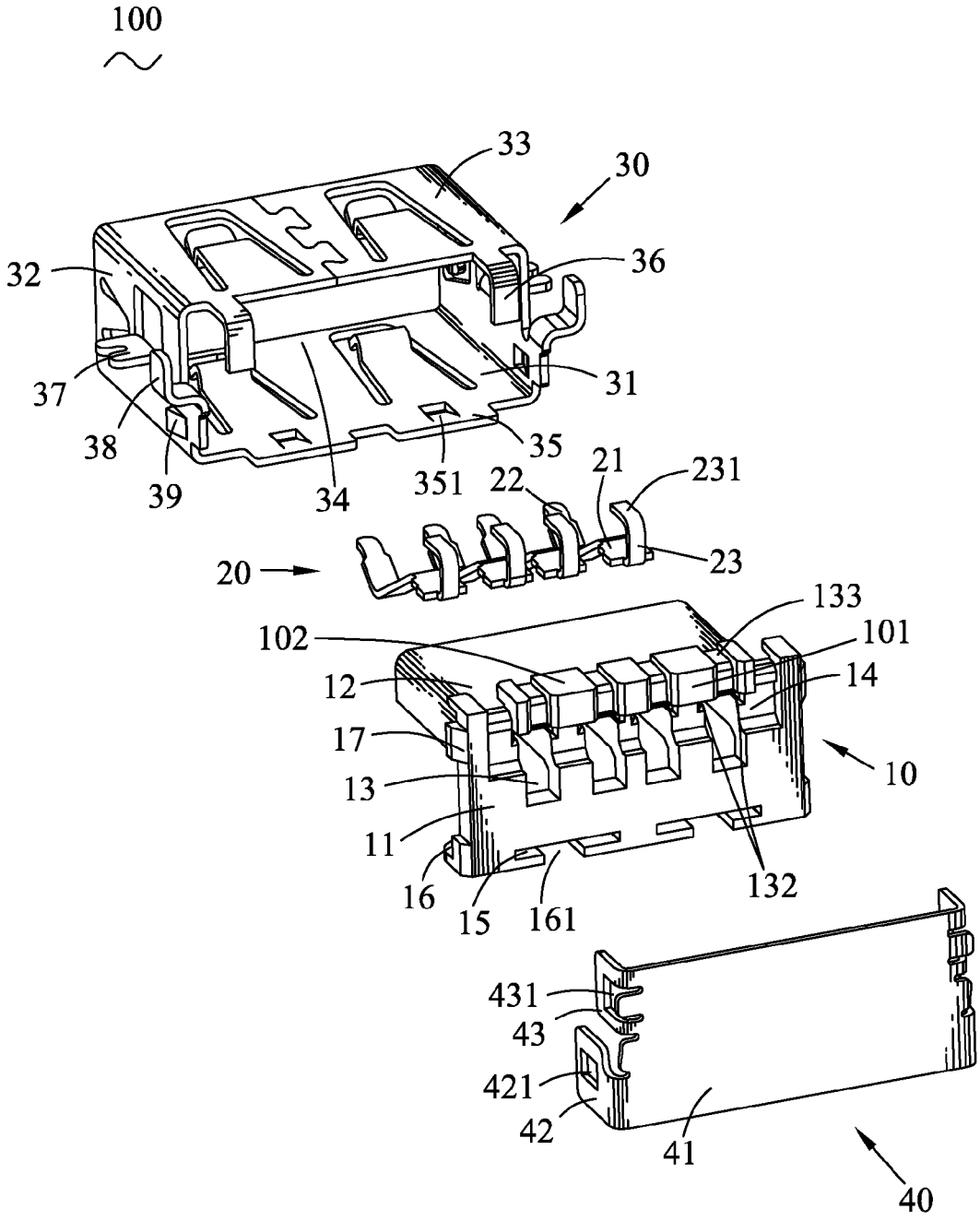
FIG. 5 is another angle of exploded view of the electrical connector of FIG. 1.

Referring to FIG. 4 and FIG. 5, the insulating housing 10 has a rectangular base body 11 and a tongue portion 12 protruding forward from a lower portion of a front of the base body 11. The insulating housing 10 defines a plurality of terminal grooves 13 arranged at regular intervals along a transverse direction of the insulating housing 10. Each of the terminal grooves 13 includes a passage 131 extending longitudinally to pass through a top of the tongue portion 12 and the base body 11, a pair of fastening slots 132 extending oppositely from two opposite sides of a rear of the passage 131, and an L-shaped receiving slot 133 passing through a rear surface 101 and a bottom surface 102 of the base body 11, and communicating with the rear of the passage 131. The insulating housing 10 defines a pair of L-shaped fastening grooves 14 each of which passing through a lower portion of the rear surface 101 and the bottom surface 102. Two portions of an upper portion of the front of the base body 11 define two inserting slots 15 extending longitudinally to penetrate through the base body 11. A top of the front of the base body 11 extends forward to form an extending board 16 located above the inserting slots 15. Two portions of a rear of the extending board 16 are cut off to form two buckling grooves 161 respectively communicating with middles of the two inserting slots 15. Two lower portions of two sides of the base body 11 are protruded oppositely to define two blocking portions 17.

Referring to FIG. 4 and FIG. 5, each of the terminals 20 has a fastening portion 21 of a plate shape. A middle of a front of the fastening portion 21 is inclined upward and forward, and then arced downward to form a contact portion 22. A middle of a rear end of the fastening portion 21 is bent downward, and then extends forward to form a soldering portion 23.

Referring to FIG. 4 and FIG. 5, the main shielding shell 30 includes a top plate 31, two side plates 32 extending downward from two opposite sides of the top plate 31, and a bottom plate 33 connecting with two fronts of two bottom sides of the two side plates 32. An accommodating space 34 is formed among the top plate 31, the two side plates 32 and the bottom plate 33. Two portions of a rear end of the top plate 31 extend rearward to form two inserting plates 35 spaced from each other. A middle of each inserting plate 35 is punched upward to form a buckling piece 351. Two portions of a rear side of the bottom plate 33 extend rearward, and then are bent upward to form two fastening plates 36. A substantial middle of the side plate 32 is cut off to define an opening 321, and a bottom of a rear end of the side plate 32 is cut off to define a gap 322. An inner top end of the opening 321 is bent outward to form a soldering plate 37. An inner top end of the gap 322 is bent outward, and then extends downward to form a soldering foot 38. Two portions of the two rear ends of the two side plates 32 are punched oppositely to define two wedging pieces 39.

Referring to FIG. 4 and FIG. 5 again, the auxiliary shielding shell 40 has a base plate 41. Two upper portions of two sides of the base plate 41 are bent forward to form two first bending plates 42 with two wedging holes 421 being opened therein. Two lower portions of the two sides of the base plate 41 are bent forward to form two second bending plates 43 with two blocking holes 431 being opened therein.

Referring to FIG. 2, FIG. 3, FIG. 4 and FIG. 5, when the electrical connector 100 is assembled, the terminals 20 are assembled in the terminal grooves 13 of the insulating housing 10. The contact portions 22 are located in fronts of the passages 131 with top ends thereof projecting beyond the top of the tongue portion 12. The fastening portions 21 are fastened in the rears of the passages 131 with two sides thereof fastened in the two fastening slots 132. The soldering portions 23 are disposed in the receiving slots 133 with bottom faces 231 thereof in alignment with the bottom surfaces 102 of the base body 11. The tongue portion 12 of the insulating housing 10 together with the terminals 20 is inserted into the accommodating space 34 of the main shielding shell 30 with the tongue portion 12 being apart from periphery inner sides of the main shielding shell 30 to define an insertion space 80 between the periphery inner sides of the main shielding shell 30 and periphery outer sides of the tongue portion 12. A mated connector (not shown) is inserted into the insertion space 80 to contact with the top ends of the contact portions 22 of the terminals 20. The inserting plates 35 are inserted in the inserting slots 15 to make the extending board 16 located on the rear end of the top plate 31 of the main shielding shell 30 and the buckling pieces 351 buckled in the buckling grooves 161. The fastening plates 36 are fastened in the fastening grooves 14. The rear end of the bottom plate 33 resists against a front end of a bottom of the base body 11. The base plate 41 of the auxiliary shielding shell 40 is positioned to the rear surface 101 of the base body 11 with the first bending plates 42 attached to the rear ends of the side plates 32 to make the wedging pieces 39 wedged in the wedging holes 421, and the blocking portions 17 blocked in the blocking holes 431 of the second bending plates 43 to cover up top portions of the soldering portions 23 which are exposed to the rear surface 101 of the base body 11 through the receiving slots 133 so as to make the first bending plates 42 electrically abut against the side plates 32 and further make the base plate 41 tightly covered to the rear surface 101 of the base body 11. When the electrical connector 100 is mounted on the circuit board, the bottom faces 231 of the soldering portions 23 are soldered on the circuit board. The soldering plates 37 and the soldering feet 38 are soldered to the circuit board.

As described above, the base plate 41 of the auxiliary shielding shell 40 is positioned to the rear surface 101 of the base body 11 with the first bending plates 42 attached to the rear ends of the side plates 32 of the main shielding shell 30 to make the wedging pieces 39 wedged in the wedging holes 421 to cover up the top portions of the soldering portions 23. The bottom faces 231 of the soldering portions 23 are in alignment with the bottom surface 102 of the base body 11 to be soldered on the circuit board. As a result, the soldering portion 23 of the terminal 20 has no exposure area after being soldered on the circuit board so as to ensure a better electromagnetic shielding function.

What is claimed is:

1. An electrical connector adapted for being soldered on a circuit board, comprising:

an insulating housing having a base body and a tongue portion protruding forward from a front of the base body, the insulating housing defining a plurality of terminal grooves of which each includes a passage extending longitudinally to pass through a top of the tongue portion and the base body, and a receiving slot passing through a rear surface and a bottom surface of the base body, and communicating with the passage;

a plurality of terminals received in the terminal grooves of the insulating housing, each terminal having a fastening portion fastened in a rear of the passage, a contact portion connecting with a front of the fastening portion to be located in the passage and elastically project beyond the top of the tongue portion, and a soldering portion bent downward and then extending forward from a rear of the fastening portion to be disposed in the receiving slot, a bottom face of the soldering portion being in alignment with the bottom surface of the base body to be soldered on the circuit board;

a main shielding shell surrounding the tongue portion together with the terminals with the tongue portion being apart from periphery inner sides of the main shielding shell to define an insertion space between the periphery inner sides of the main shielding shell and periphery outer sides of the tongue portion; and an auxiliary shielding shell having a base plate positioned to the rear surface of the base body to cover up top portions of the soldering portions of the terminals which are exposed to the rear surface of the base body through the receiving slots, and two bending plates bent forward from two opposite sides of the base plate to be electrically attached to the main shielding shell.

2. The electrical connector as claimed in claim 1, wherein an upper portion of the front of the base body defines two inserting slots, the main shielding shell has a top plate, two portions of a rear end of the top plate extend rearward to form two inserting plates inserted in the inserting slots.

3. The electrical connector as claimed in claim 2, wherein a top of the front of the base body extends forward to form an extending board located on the rear end of the top plate of the main shielding shell, a rear of the extending board defines two buckling grooves respectively connected with substantial middles of the inserting slots, each inserting plate is punched upward to form a buckling piece buckled in the buckling groove.

4. The electrical connector as claimed in claim 1, wherein each of the bending plates of the auxiliary shielding shell has a wedging hole opened therein, the main shielding shell has two side plates of which each rear end is punched outward to form a wedging piece wedged in the wedging hole of the bending plate to make the bending plate electrically abut against the side plate and further make the base plate tightly covered to the rear surface of the base body.

5. The electrical connector as claimed in claim 4, wherein the bending plates of the auxiliary shielding shell are formed by being bent forward from two upper portions of the two sides of the base plate and are designated as two first bending plates, two lower portions of the two sides of the base plate are bent forward to form two second bending plates with two blocking holes being opened therein respectively, lower portions of two sides of the base body oppositely protrude outward to define two blocking portions buckled in the blocking holes of the second bending plates.

* * * * *